US007334716B2

(12) United States Patent
Tsai

(10) Patent No.: US 7,334,716 B2
(45) **Date of Patent: *Feb. 26, 2008**

(54) STAPLER CAPABLE OF CUTTING STAPLE LEGS ONE AFTER ANOTHER

(75) Inventor: Eric Tsai, Taichung Hsien (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 171 days.

This patent is subject to a terminal disclaimer.

(21) Appl. No.: 11/043,330

(22) Filed: Jan. 26, 2005

(65) Prior Publication Data

US 2006/0163311 A1 Jul. 27, 2006

(51) Int. Cl.
*B25C 5/02* (2006.01)

(52) U.S. Cl. ..... 227/155; 227/79; 227/76; 227/154; 227/134; 221/120

(58) Field of Classification Search ..... 227/79, 227/76, 154, 155, 134, 120; 403/397, 241, 403/338; 292/164, DIG. 11
See application file for complete search history.

(56) References Cited

U.S. PATENT DOCUMENTS

| | | | | |
|---|---|---|---|---|
| 1,962,874 A | | 6/1934 | Polzer | |
| 2,083,227 A | | 6/1937 | Drypolcher | 227/76 |
| 2,267,185 A | * | 12/1941 | Bauwens | 227/77 |
| 3,034,382 A | | 5/1962 | Herbert | 29/566 |
| 4,199,095 A | | 4/1980 | Yamanoi | 227/125 |
| 4,378,085 A | | 3/1983 | McVeigh | 227/79 |
| 4,449,661 A | | 5/1984 | Spehrley, Jr. | 227/155 |
| 4,593,847 A | | 6/1986 | Hagemann | 227/155 |
| 4,664,305 A | | 5/1987 | Blake et al. | 227/19 |
| 4,844,319 A | | 7/1989 | Kurosawa | 227/79 |
| 5,029,745 A | | 7/1991 | Akizawa et al. | 227/155 |
| 5,147,055 A | * | 9/1992 | Samson et al. | 220/259.2 |
| 5,413,266 A | | 5/1995 | Jairam | 227/129 |
| 5,516,025 A | | 5/1996 | Eriksson | 227/155 |
| 5,586,710 A | | 12/1996 | Golicz | 227/155 |
| 5,639,007 A | | 6/1997 | Nakamura | 227/109 |
| 5,645,567 A | | 7/1997 | Crainich | 606/219 |
| 5,678,745 A | * | 10/1997 | Yoshie | 227/4 |
| 5,758,813 A | | 6/1998 | Kikuchi et al. | 227/155 |
| 5,791,543 A | | 8/1998 | Udagawa et al. | 227/4 |
| 6,036,074 A | | 3/2000 | Manabe | 227/155 |
| 6,056,183 A | | 5/2000 | Tanabe | 227/155 |
| 6,179,193 B1 | * | 1/2001 | Nagai | 227/123 |

(Continued)

FOREIGN PATENT DOCUMENTS

DE 44 34 513 C1 8/1995

OTHER PUBLICATIONS

PCT Patent Publication No. WO 03/057417 A1, Jul. 17, 2003.

*Primary Examiner*—Rinaldi I. Rada
*Assistant Examiner*—Michelle Lopez
(74) *Attorney, Agent, or Firm*—Alan Kamrath; Kamrath & Associates PA

(57) ABSTRACT

A stapler includes a base, a cover, two clips, a feeding device and a bending and cutting device. The cover is installed on the base. The clips connect the cover with the base. The feeding device feeds staples. The security device ensures normal movement of the cover. The bending and cutting device bends and cuts the legs of each staple one after another.

54 Claims, 10 Drawing Sheets

U.S. PATENT DOCUMENTS

| | | | | |
|---|---|---|---|---|
| 6,250,531 | B1 | 6/2001 | Yagi | 227/79 |
| 6,535,380 | B1 * | 3/2003 | Lee et al. | 361/683 |
| 6,637,635 | B2 | 10/2003 | Borjesson et al. | 227/155 |
| 6,698,640 | B2 | 3/2004 | Hakozaki et al. | 227/4 |
| 6,776,321 | B2 | 8/2004 | Jairam et al. | 227/134 |
| 6,820,790 | B2 | 11/2004 | Ura | 227/131 |
| 6,935,547 | B2 | 8/2005 | Mochizuki | 227/131 |
| 6,942,136 | B2 | 9/2005 | Tsai | 227/155 |
| 6,981,626 | B1 * | 1/2006 | Tsai | 227/79 |
| 6,981,627 | B2 | 1/2006 | Tsai | 227/155 |
| 7,021,515 | B2 * | 4/2006 | Elonsson et al. | 227/134 |
| 2003/0111506 | A1 | 6/2003 | Kanai et al. | 227/131 |
| 2006/0118593 | A1 | 6/2006 | Tsai | 227/76 |

* cited by examiner

STAPLER CAPABLE OF CUTTING STAPLE LEGS ONE AFTER ANOTHER

BACKGROUND OF INVENTION

1. Field of Invention

The present invention relates to a stapler capable of cutting staple legs one after another.

2. Background of Invention

WO 03/057417 A1 discloses a STAPLER WITH BENDING ARMS WHICH CUT THE STAPLER LEGS AGAINST A PAD. The stapler includes two bending arms 40 and 41 and a cutter 49 (see FIGS. 9 and 10). The bending arm 40 is pivotally installed by a pin 42. The bending arm 40 includes a lever 45 on a side of the pin 42 and a bending surface 44 on the other side of the pin 42. The bending arm 41 is pivotally installed by a pin 43. The bending arm 41 includes a lever 48 on a side of the pin 43 and a bending surface 47 on the other side of the pin 43. The cutter 49 is located between the bending surfaces 44 and 47. As the levers 45 and 48 are pivoted, the bending surfaces 44 and 47 bend and press stapler legs 53 and 54 against two cutting edges of the cutter 49. Thus, the staple legs 53 and 54 are cut. It, however, requires a large force to cut the stapler legs 53 and 54 simultaneously.

The present invention is therefore intended to obviate or at least alleviate the problems encountered in the prior art.

SUMMARY OF INVENTION

According to the present invention, a stapler includes a base, a cover, two clips, a feeding device and a bending and cutting device. The cover is installed on the base. The clips connect the cover with the base. The feeding device feeds staples. The security device ensures normal movement of the cover. The bending and cutting device bends and cuts the legs of each staple one after another.

The primary advantage of the stapler according to the present invention is that it requires a smaller force than the prior art because of the clips.

Other advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
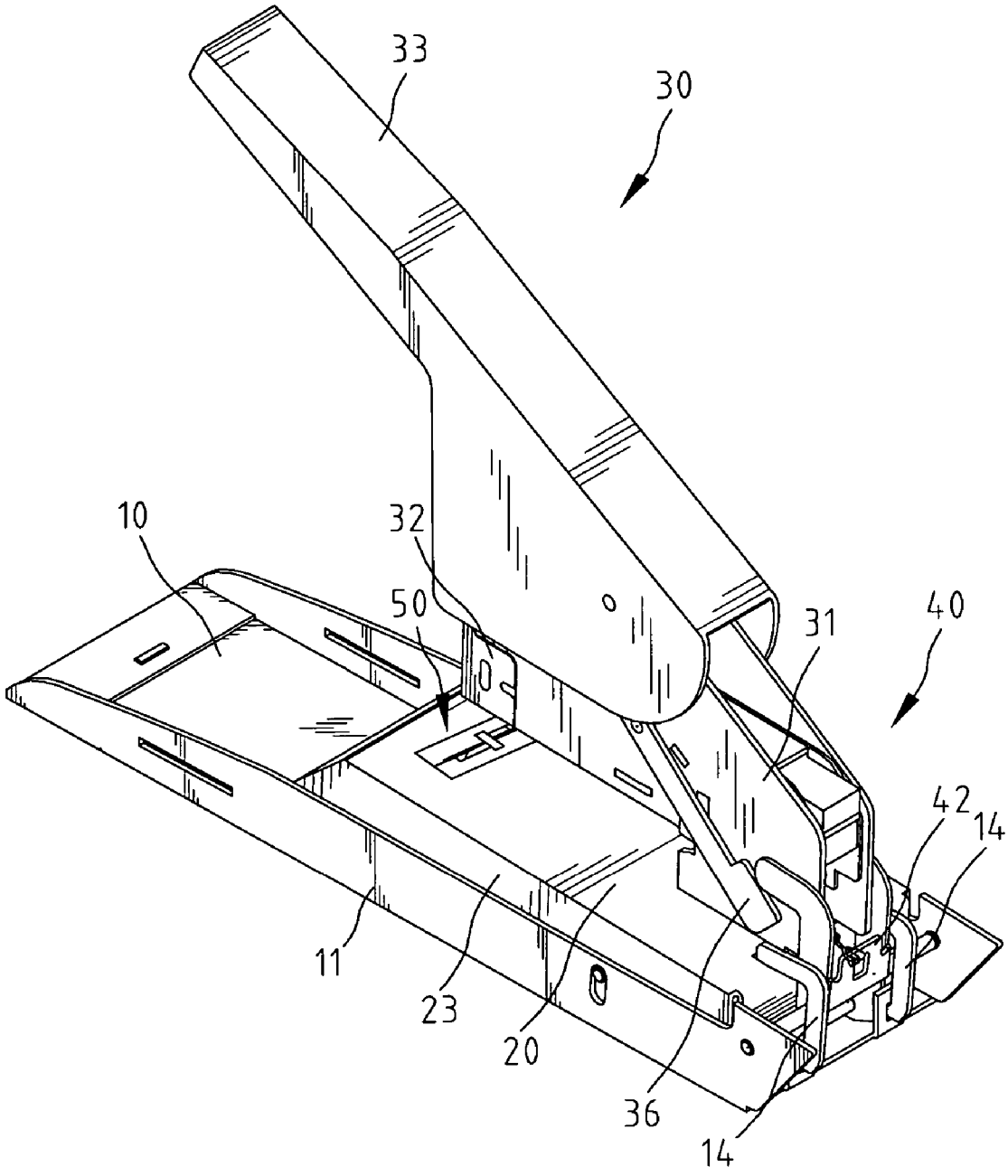
FIG. 1 is a perspective view of a stapler according to the preferred embodiment of the present invention.

Referring to FIGS. 1 through 4, according to the preferred embodiment of the present invention, a stapler includes a base 10, a cover 20 installed on the base 10, a feeding device 30 for feeding staples 60 (FIG. 7), a security device 40 for ensuring normal movement of the cover 20 and a bending and cutting device 50 detachably detached to the cover 20 for bending and cutting the legs 61 and 62 of the staples 60 one after another.

Figure 2:
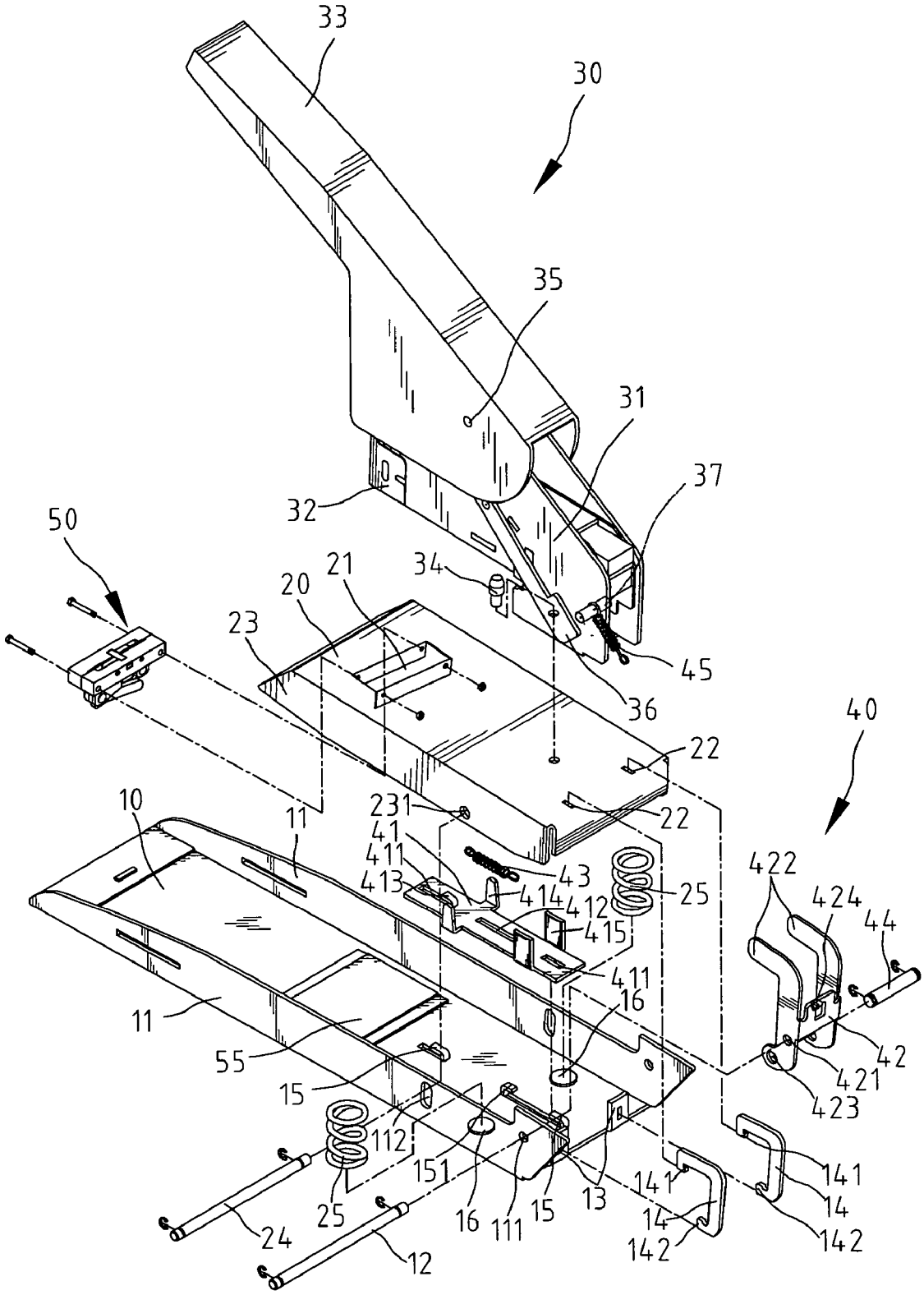
FIG. 2 is an exploded view of the stapler shown in FIG. 1.
Figure 4:
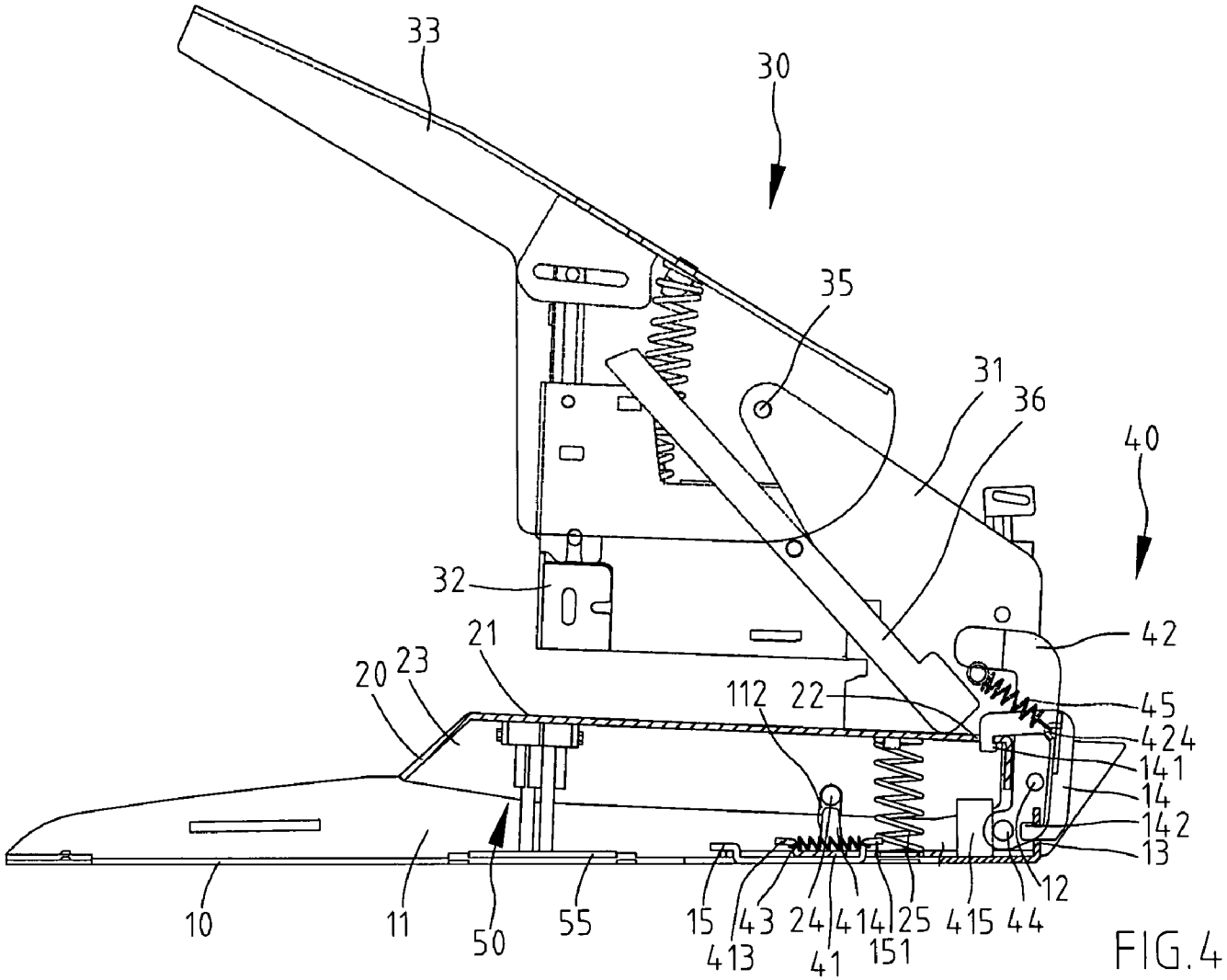
FIG. 4 is a cross-sectional view of the stapler shown in FIG. 1.

Referring to FIGS. 2 and 4, the base 10 includes two walls 11 formed thereon. Each wall 11 defines a vertical slot 112 and an aperture 111. Two bosses 16 are formed on the base 10. Two hooks 15 are formed on the base 10. A hook 151 is formed on the base 10. The hook 151 is located between the hooks 15. The hook 151 extends opposite to the hooks 15. Two lugs 13 are formed on the base 10.

The cover 20 includes two walls 23 extending from the cover 20. Each wall defines an aperture 231. The cover 20 defines two slots 22 and an opening 21.

To connect the base 10 with the cover 20, a pin 24 and two clips 14 are used. The pin 24 is inserted in the slots 112 and the apertures 231. Each clip 14 includes a lower end 142 hooking a related lug 13 and an upper end 141 inserted in a related slot 22. Two springs 25 are compressed between the base 10 and the cover 20. Each spring 25 receives a related boss 16 at an end.

The feeding device 30 includes a mount 31, a cartridge 32, a lever 33, two extensions 36 and a pin 37. The mount 31 is attached to the cover 20 by a fastener 34. The cartridge 32 is connected with the mount 31 for storing the staples 60. The lever 33 is connected by a pin 35 with the mount 31 for moving the cartridge 32, driving the staples 60 from the cartridge 32 and moving the cover 20. The extensions 36 extend from the lever 33. A pin 37 is connected with the mount 31.

The security device 40 includes a slide 41, a spring 43, a link 42, a pin 44 and a spring 45. The slide 41 includes two slots 411 defined therein, a slot 412 defined therein between the slots 411, a hook 413 formed thereon, two fins 414 formed thereon and two fins 415 formed thereon. The slide 41 is installed on the base 10. The slots 411 receive the hooks 15. The slot 412 receives the hook 151. The spring 43 includes an end hooked to the hook 413 and an opposite end hooked to the hook 151 so that the slide 41 is biased by the spring 43.

The link 42 includes two lateral members 422. Each lateral member 422 includes a lower end defining an aperture 423 for receiving the pin 12. Each lateral member 422 includes an upper end for contact with a related extension 36. Each lateral member 422 defines an aperture 421 for receiving a pin 44 that is for contact with the fins 415. The link 42 includes a hook 424 formed thereon. The spring 45 includes an end hooked to the hook 424 and an opposite end hooked to the pin 37.

Figure 3:
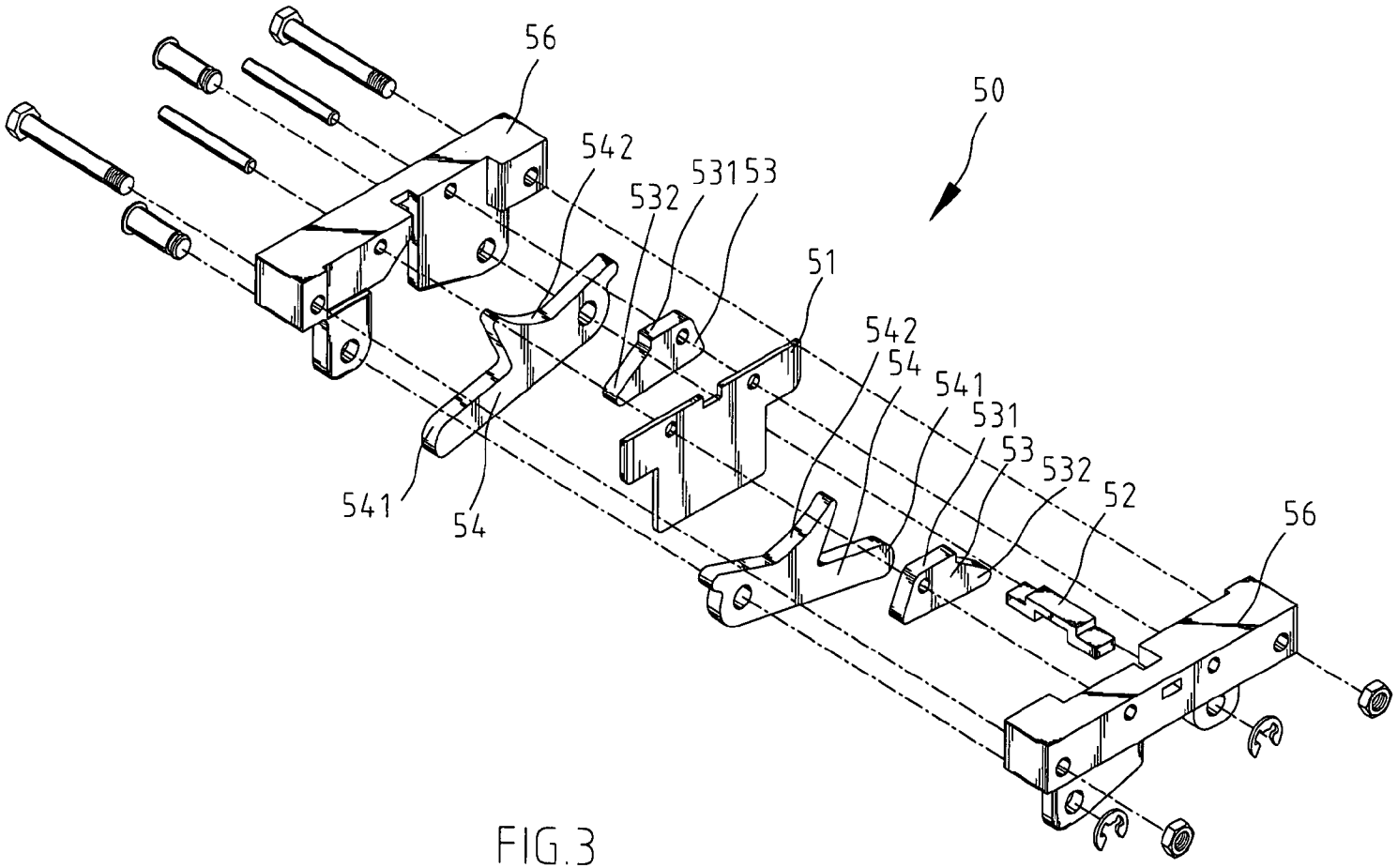
FIG. 3 is an exploded view of a bending and cutting device used in the stapler shown in FIG. 2.
Figure 5:
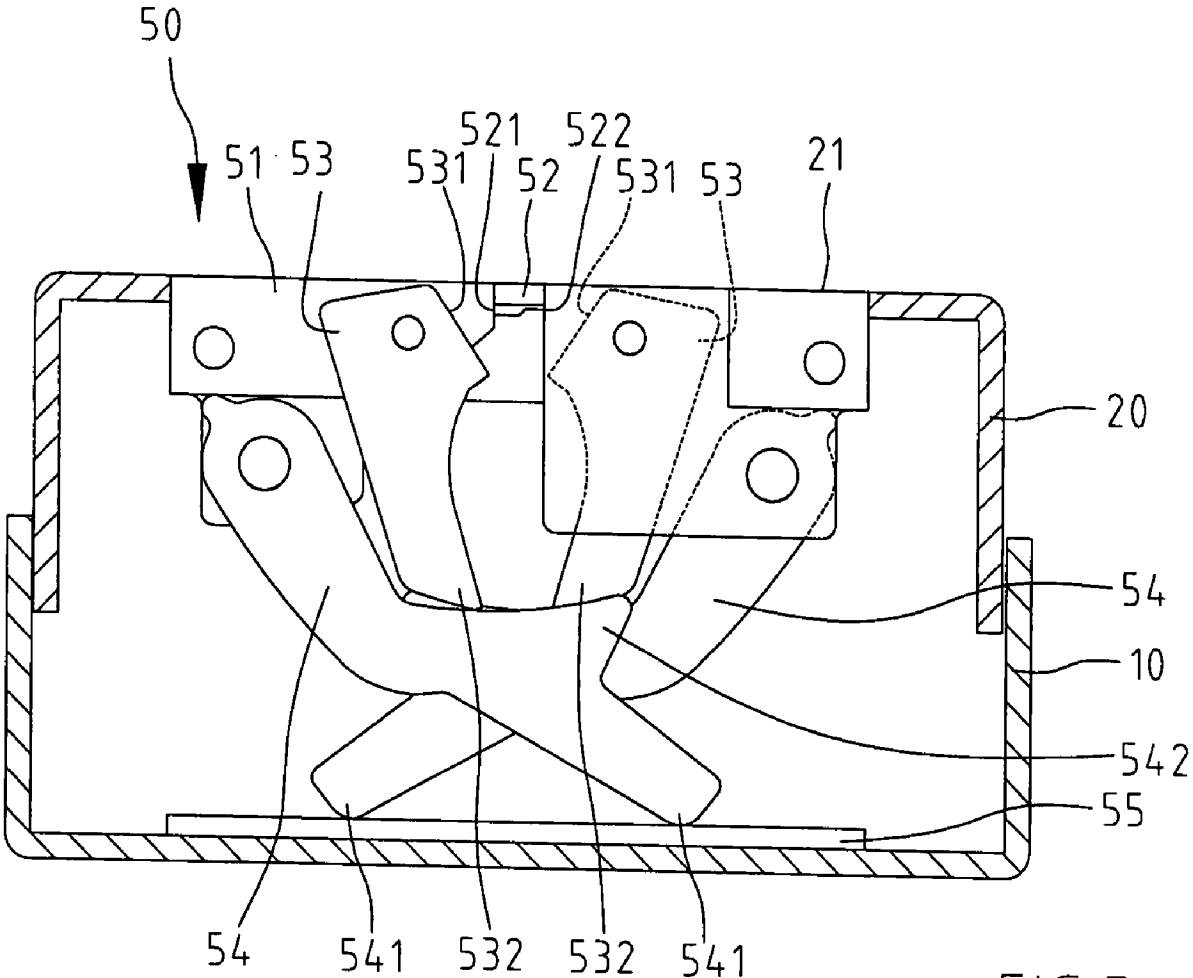
FIG. 5 is an enlarged cross-sectional view of the stapler shown in FIG. 4.

Referring to FIGS. 3 and 5, the bending and cutting device 50 is attached to two vertical plates (not numbered but shown in FIG. 2) extending from the cover 20 by the opening 21 in a detachable manner. The bending and cutting device 50 includes a frame 55, a cutting element 52 attached to the frame 56, first and second bending elements 53 pivotally connected with the frame 56 and first and second levers 54 pivotally connected with the frame 56. A partition 51 is provided in the frame 56 in order to separate the first bending element 53 and the first lever 54 from the second bending element 53 and the second lever 54. The frame 56 includes two halves each defining an aperture for receiving an end of the cutting element 52. A pad 55 is attached to the base 10 for contact with the levers 54.

The cutting element 52 includes a first cutting portion 521 and a second cutting portion 522 thinner than the first cutting portion 521.

Each bending element 53 includes an upper end 531 for bending and pressing a first leg 61 of each staple 60 against the first cutting portion 521 and a lower end 532. The second bending element 53 includes an upper end 531 for bending and pressing a second leg 62 of each staple 60 against the second cutting portion 522 and a lower end 62.

The first lever 54 includes a lower end 541 in contact with the pad 55 and a middle portion 542 for pushing the lower end 532 of the first bending element 53. The second lever 54 includes a lower end 541 in contact with the pad 55 and a middle portion 542 for pushing the lower end 532 of the second bending element 53.

The cover 20 cannot be pivoted towards the base 10 because the pin 24 is hindered by the fins 414 from below.

Figure 6:
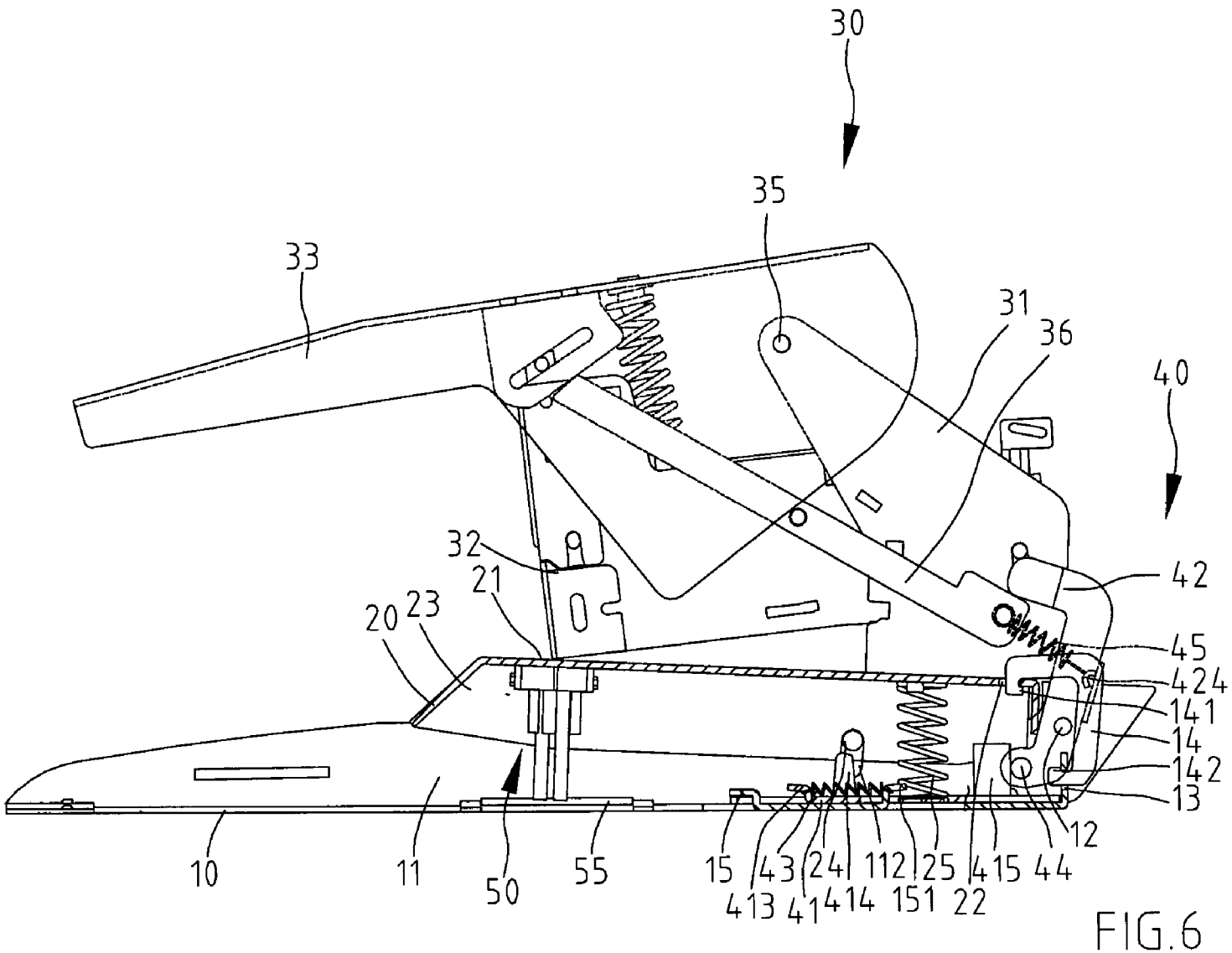
FIG. 6 is similar to FIG. 4 but shows the stapler in a different position.
Figure 7:
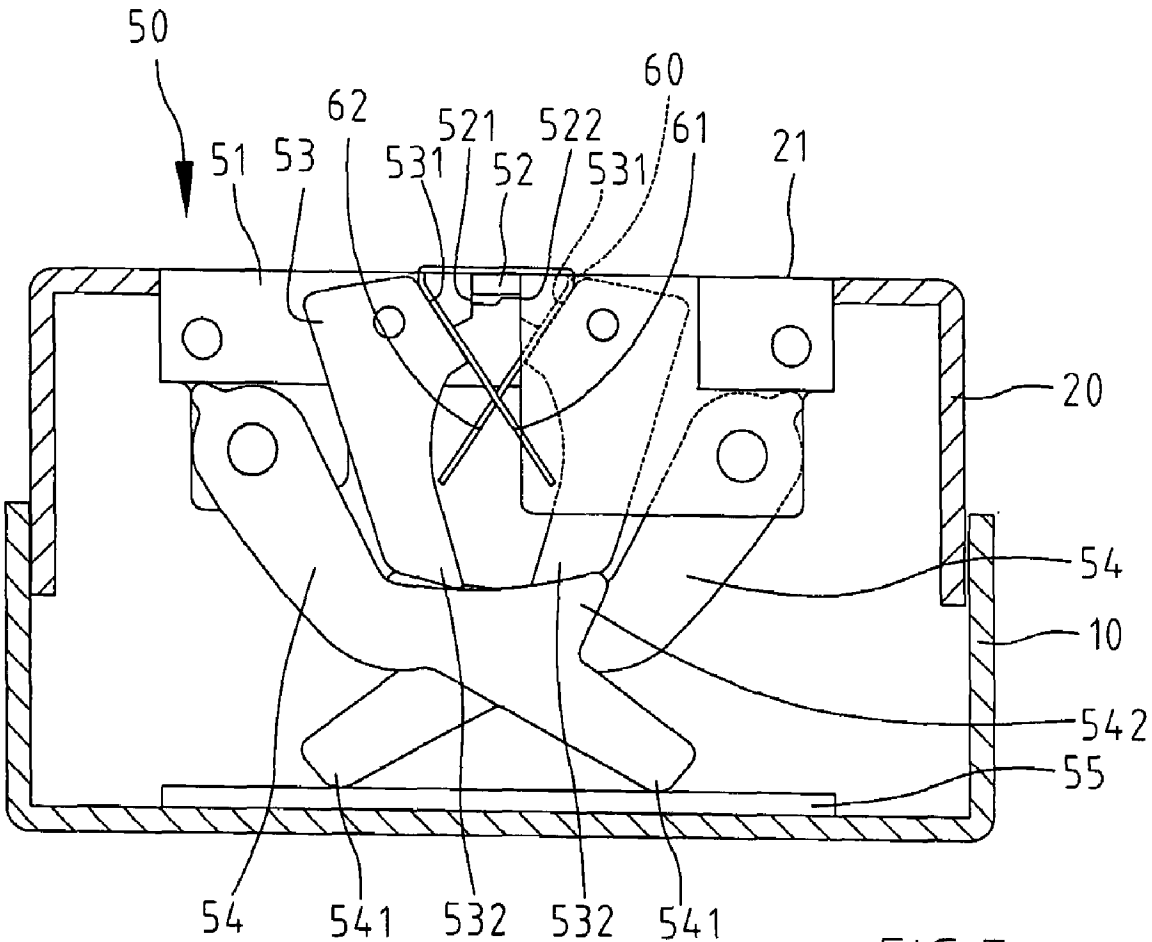
FIG. 7 is an enlarged cross-sectional view of the stapler shown in FIG. 6.

Referring to FIGS. 6 and 7, as the lever 33 is pivoted about the pin 35, the cartridge 32 is moved toward the cover 20, and the extensions 36 push the lateral members 422 of the link 42 so that the link 42 is pivoted about the pin 44. The pin 44 pushes the fins 415. The pin 24 moves from the fins 414. A staple 60 is fed to the bending and cutting device 50 from the cartridge 32 through the opening 21. The first leg 61 of the staple 60 is bent against the upper end 531 of the first bending element 53. The second leg 62 of the staple 60 is bent against the upper end 531 of the second bending element 53. The fins 414 are still beneath the pin 24 in order to prevent the cover 20 from pivoting towards the base 10. Hence, the bending and cutting device 50 has not been moved.

Figure 8:
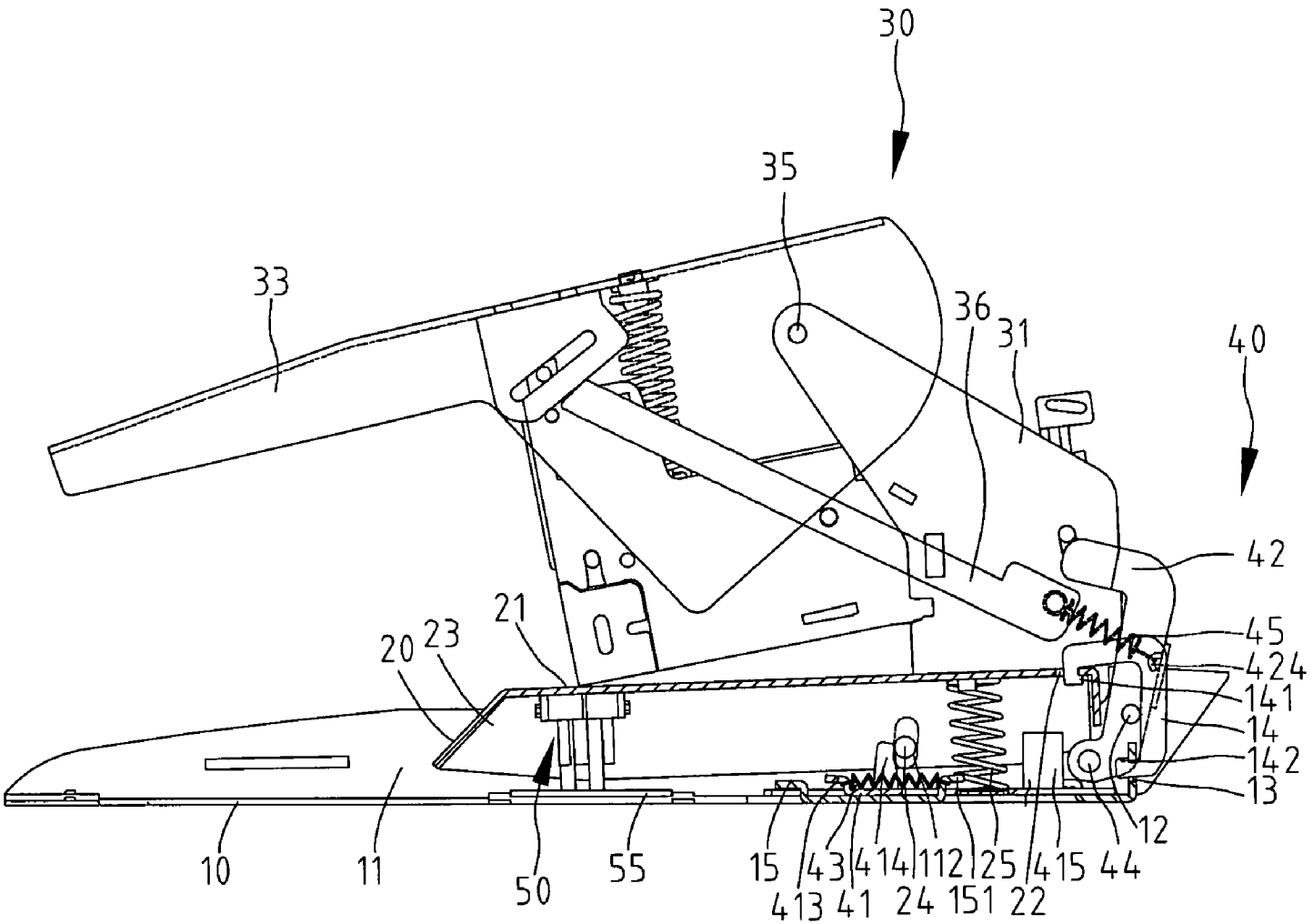
FIG. 8 is similar to FIG. 6 but shows the stapler in a different position.

Referring to FIG. 8, as the cartridge 32 contacts the cover 20, the fins 414 are not beneath the pin 24 in order to allow pivoting of the cover 20 towards the base 10. The cover 20 is pivoted towards the base 10 about the clips 14. The distance measured from the opening 21 to the clips 14 is long which is advantageous in providing a large torque. The clips 14 provide elasticity that can be felt. Because of the clips 14, the stapler according to the present invention requires a smaller force than the conventional stapler discussed in the Related Prior Art.

Figure 9:
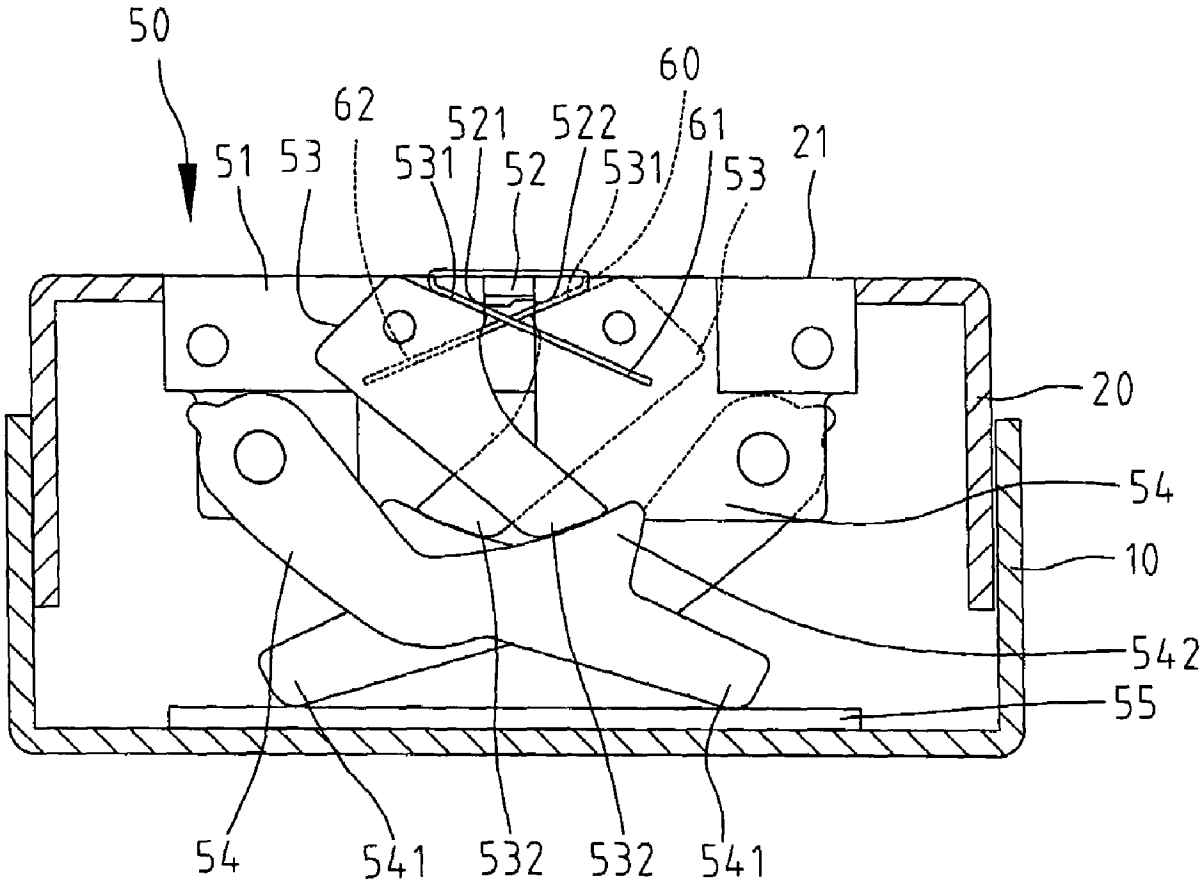
FIG. 9 is an enlarged cross-sectional view of the stapler shown in FIG. 8.

Referring to FIG. 9, as the cover 20 moves towards the base 10, the pad 55 pushes the levers 54. The middle portions 542 of the levers 54 push the lower ends 532 of the bending elements 53. The upper end 531 of the first bending element 53 presses and cuts the first leg 61 of the staple 60 against the first cutting portion 521 before the upper end 531 of the second bending element 53 presses and cuts the second leg 62 of the staple 60 against the first cutting portion 521. Thus, it does not require a large force to cause the upper ends 531 of the bending elements 53 to press the legs 61 and 62 against the cutting element 52 at the same time.

Figure 10:
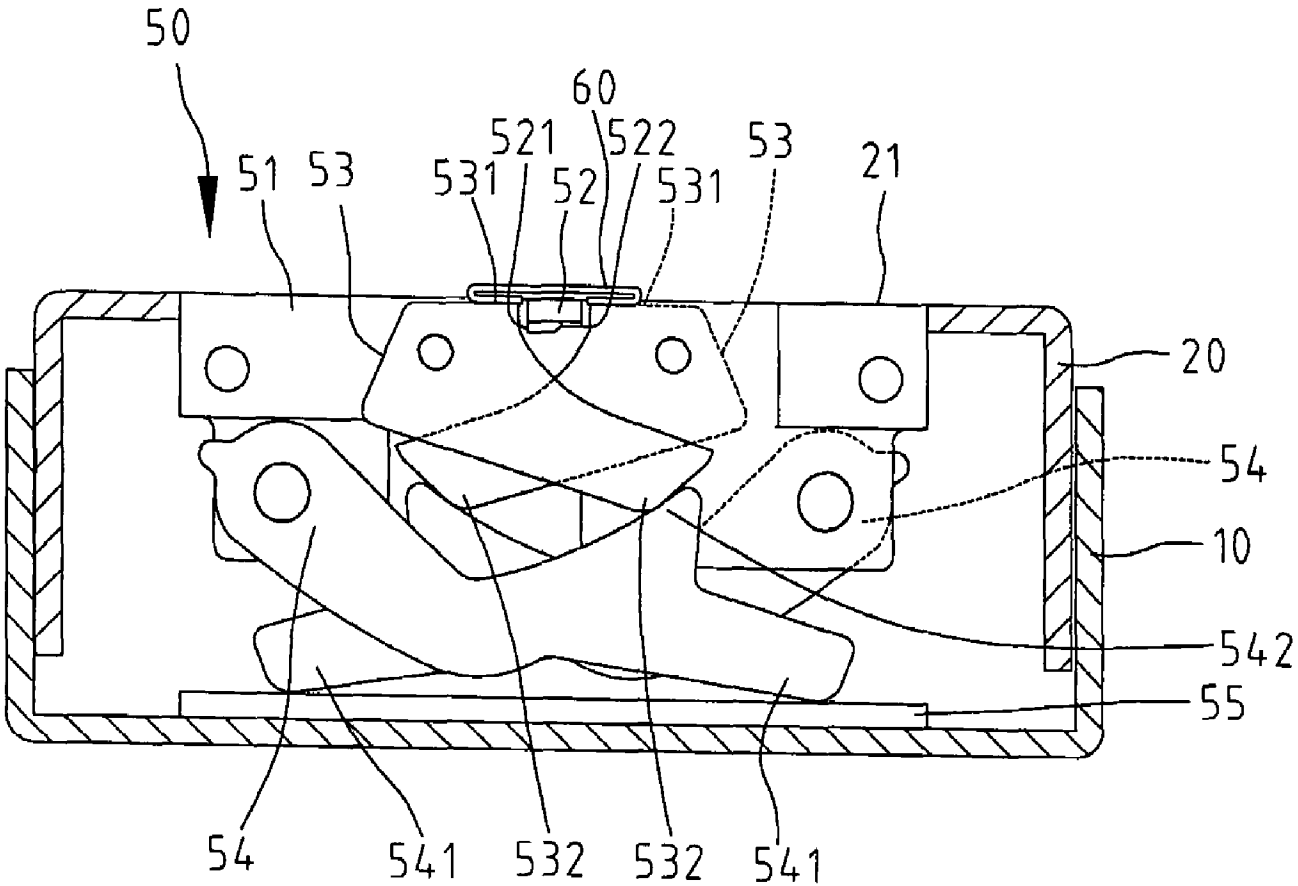
FIG. 10 is similar to FIG. 9 but shows the stapler in a different position.

Referring to FIG. 10, the legs 61 and 62 are bent. The distance measured from the contact point between each lever 54 and the pad 55 to the pivot point of each lever 54 is longer than the distance measured from the contact point between each lever 54 and a related bending element 53 to the pivot point. Thus, the levers 54 provide a mechanical efficiency greater than 1. Because of the levers 54, the stapler according to the present invention requires a smaller force than the conventional stapler discussed in the Related Prior Art.

Furthermore, as the bending and cutting device 50 is made as a separate unit, it can be replaced with a new one when the cutting element 52 becomes obtuse after a long time of use. This saves money because the entire stapler does not have to be replaced with a new one as required in the prior art.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A stapler comprising a base; a cover installed on the base; two clips pivotally connecting the cover with the base for pivotal movement between a receiving position and a stapling position; a feeding device for feeding staples having first and second legs; and a bending device for bending the first and second legs of each staple, with the two clips each being C-shaped and having a first end connected to the base and a second end spaced from the first end and connected to the cover, wherein the base comprises two lugs formed thereon, wherein the cover defines two slots, wherein each of the clips includes the first end hooking one of the lugs and the second end inserted in one of the slots.

2. A stapler comprising a base; a cover installed on the base; two clips pivotally connecting the cover with the base for pivotal movement between a receiving position and a stapling position; a feeding device for feeding staples having first and second legs; a bending device for bending the first and second legs of each staple, with the two clips each being C-shaped and having a first end connected to the base and a second end spaced from the first end and connected to the cover; and a security device for controlling pivotal movement of the cover relative to the base, wherein the security device comprises a slide movable on the base between a first position and a second position, with the slide hindering movement of the cover in the first position and releasing the cover in the second position.

3. The stapler according to claim 2 wherein the slide comprises at least one fin for abutting the cover.

4. The stapler according to claim 3 wherein the cover comprises a pin installed thereon for abutting the fin of the slide.

5. The stapler according to claim 2 wherein the slide defines two slots, wherein the cover comprises two hooks inserted in the slots of the slide.

6. The stapler according to claim 2 comprising a spring tending to keep the slide in the first position.

7. The stapler according to claim 6 wherein the slide comprises a hook for hooking the spring, wherein the base comprises a hook for hooking the spring.

8. A stapler comprising a base; a cover installed on the base; two clips for connecting the cover with the base; a feeding device for feeding staples having first and second legs; a bending device for bending the first and second legs of each staple; and a security device controlling movement of the cover relative to the base, wherein the security device comprises a slide movable on the base between a first position and a second position, with the slide hindering movement of the cover in the first position and releasing the cover in the second position, and a link for moving the slide under control of the feeding device.

9. The stapler according to claim 8 wherein the slide comprises at least one fin formed thereon, wherein the link comprises two lateral members pivotally connected with the base and a pin extending between the lateral members for contact with the fin of the slide.

10. The stapler according to claim 9 comprising a pin for pivotally connecting the lateral members of the link with the base.

11. The stapler according to claim 9 wherein the feeding device comprises:

a mount installed on the cover;

a cartridge connected with the mount for storing the staples;

a lever connected with the mount for moving the cartridge, driving the staples from the cartridge and moving the cover; and two extensions extending from the lever for lifting the lateral members of the link.

12. The stapler according to claim 11 comprising a spring for connecting the link with the mount.

13. The stapler according to claim 12 wherein the feeding device comprises a pin installed on the mount for connecting with the spring.

14. The stapler according to claim 12 wherein the link comprises a hook for hooking the spring.

15. The stapler according to claim 11 comprising a fastener for securing the mount to the cover.

16. The stapler according to claim 11 comprising a pin for connecting the lever with the mount.

17. A stapler comprising a base; a cover installed on the base; two clips pivotally connecting the cover with the base for pivotal movement between a receiving position and a stapling position; a feeding device for feeding staples having first and second legs; a bending device for bending the first and second legs of each staple, with the two clips each being C-shaped and having a first end connected to the base and a second end spaced from the first end and connected to the cover; and at least one spring compressed between the base and the cover.

18. The stapler according to claim 17 wherein the base comprises at least one boss fit in the spring.

19. The stapler comprising a base; a cover installed on the base; two clips pivotally connecting the cover with the base for pivotal movement between a receiving position and a stapling position; a feeding device for feeding staples having first and second legs; and a bending device for bending the first and second legs of each staple, with the two clips each being C-shaped and having a first end connected to the base and a second end spaced from the first end and connected to the cover, wherein the bending device comprises a cutting element formed with a first cutting portion and a second cutting portion so that the first cutting portion cuts the first leg of each staple before the second cutting portion cuts the second leg of each staple.

20. The stapler according to claim 19 wherein the first cutting portion is thicker than the second cutting portion.

21. The stapler according to claim 19 wherein the bending device comprises a first bending element for bending the first leg of the staple and a second bending element for bending the second leg of the staple, wherein each of the bending elements comprises an upper end for pressing one of the first and second legs of the staple.

22. A stapler comprising a base; a cover installed on the base; two clips for connecting the cover with the base; a feeding device for feeding staples having first and second legs; and a bending device for bending the first and second legs of each staple, wherein the bending device comprises a first bending element for bending the first leg of the staple and a second bending element for bending the second leg of the staple, wherein each of the bending elements comprises an upper end for pressing one of the first and second legs of the staple and a lower end, a first lever for the lower end of the first bending element, and a second lever for pushing the lower end of the second bending element.

23. The stapler according to claim 22 wherein each of the levers comprises a lower end for contact with the base and a middle portion for contact with the lower end of related one of the bending elements.

24. The stapler according to claim 23 wherein the bending device comprises a pad attached to the base for contact with the lower ends of the levers.

25. A stapler according comprising a base; a cover installed on the base; a feeding device for feeding staples having first and second legs; a bending device detachably attached to the cover as a unit, with the bending device bending the legs of each staple, wherein the cover includes two spaced, parallel plates, with a portion of the bending device located between and secured to the two spaced, parallel plates; first and second fasteners extending through the two spaced, parallel plates and the portion of the bending device; and a security device for ensuring movement of the cover relative to the base, wherein the security device comprises a slide movable on the base for hindering the covet from below in a first position and for releasing the cover in a second position, wherein the security device comprises a link for moving the slide under control of the feeding device.

26. The stapler according to claim 25 wherein the slide comprises at least one fin formed thereon, wherein the link comprises two lateral members pivotally connected with the base and a pin extending between the lateral members for contact with the fin of the slide.

27. The stapler according to claim 26 comprising a pin for pivotally connecting the lateral members of the link with the base.

28. The stapler according to claim 26 wherein the feeding device comprises:

a mount installed on the cover;

a cartridge connected with the mount for storing the staples;

a lever connected with the mount for moving the cartridge, driving the staples from the cartridge and moving the cover; and two extensions extending from the lever for lifting the lateral members of the link.

29. The stapler according to claim 28 comprising a spring for connecting the link with the mount.

30. The stapler according to claim 29 wherein the feeding device comprises a pin installed on the mount for connecting with the spring.

31. The stapler according to claim 29 wherein the link comprises a hook for hooking the spring.

32. The stapler according to claim 28 comprising a fastener for securing the mount to the cover.

33. The stapler according to claim 28 comprising a pin for connecting the lever with the mount.

34. The stapler according to claim 25 wherein the bending device comprises a frame and a cutting element put on the frame, wherein the cutting element comprises a first cutting portion and a second cutting portion so that the first cutting portion cuts the first leg of each staple before the second cutting portion cuts the second leg of each staple, with the frame of the bending device located between and secured to the two spaced, parallel plates.

35. The stapler according to claim 34 wherein the first cutting portion is thicker than the second cutting portion.

36. The stapler according to claim 34 wherein the bending device comprise a first bending element for bending the first leg of the staple and a second bending element for bending the second leg of the staple.

37. The stapler according to claim 36 wherein the bending device comprises a partition for separating the first bending element from the second bending element.

38. The stapler according to claim 36 wherein each of the bending elements comprises an upper end for pressing one of the first and second legs of the staple and a lower end.

39. The stapler according to claim 38 wherein the bending device comprises a partition for separating the first bending element and the first lever from the second bending element and the second lever.

40. The stapler according to claim 38 further comprising first and second fasteners extending through the two spaced, parallel plates and the portion of the bending device.

41. The stapler according to claim 40 comprising at least one spring compressed between the base and the cover.

42. The stapler according to claim 41 wherein the base comprises at least one boss fit in the spring.

43. A stapler comprising a base; a cover installed on the base; a feeding device for feeding staples having first and second legs; and a bending device detachably attached to the cover as a unit, with the bending device comprising a first bending element for bending the first leg and a second bending element for bending the second leg of each staple, wherein the cover includes two spaced, parallel plates, with a portion of the bending device located between and secured to the two spaced, parallel plates; wherein the bending device comprises a frame and a cutting element put on the frame, wherein the cutting element comprises a first cutting portion and a second cutting portion so that the first cutting portion cuts the first leg of each staple before the second cutting portion cuts the second leg of each staple, with the frame of the bending device located between and secured to the two spaced, parallel plates, wherein each of the bending elements comprises an upper end for pressing one of the first and second legs of the staple and a lower end, wherein the bending device comprises a first lever for pushing the lower end of the first bending element and a second lever for pushing the lower end of the second bending element.

44. The stapler according to claim 43 wherein each of the levers comprises a lower end for contact with the base and a middle portion for contact with the lower end of one of the bending elements.

45. The stapler according to claim 44 wherein the bending device comprises a pad attached to the base for contact with the lower ends of the levers.

46. The stapler according to claim 43 comprising two clips pivotally connecting the cover with the base for pivotal movement between a receiving position and a stapling position.

47. The stapler according to claim 46 wherein the base comprises two lugs formed thereon, wherein the cover defines two slots, wherein each of the clips includes an end hooking related one of the lugs and another end inserted in related one of the slots.

48. The stapler according to 43 comprising a security device for ensuring normal movement of the cover relative to the base.

49. The stapler according to claim 48 wherein the security device comprises a slide movable on the base for hindering the cover from below in a first position and for releasing the cover in a second position.

50. The stapler according to claim 49 wherein the slide comprises at least one fin for abutting the cover.

51. The stapler according to claim 50 wherein the cover comprises a pin installed thereon for abutting the fin of the slide.

52. The stapler according to claim 49 wherein the slide defines two slots, wherein the cover comprises two hooks inserted in the slots of the slide.

53. The stapler according to claim 49 comprising a spring tending to keep the slide in the first position.

54. The stapler according to claim 53 wherein the slide comprises a hook for hooking the spring, wherein the base comprises a hook for hooking the spring.

* * * * *